US007915373B2

(12) United States Patent
Shiga et al.

(10) Patent No.: US 7,915,373 B2
(45) Date of Patent: Mar. 29, 2011

(54) GOLF BALL

(75) Inventors: Kazuyoshi Shiga, Kobe (JP); Takeshi Asakura, Kobe (JP)

(73) Assignee: SRI Sports Limited, Kobe (JP)

( * ) Notice: Subject to any disclaimer, the term of this patent is extended or adjusted under 35 U.S.C. 154(b) by 553 days.

(21) Appl. No.: 12/003,466

(22) Filed: Dec. 26, 2007

(65) Prior Publication Data

US 2008/0161136 A1 Jul. 3, 2008

(30) Foreign Application Priority Data

Dec. 27, 2006 (JP) ..... 2006-353255

(51) Int. Cl.
*A63B 37/12* (2006.01)
*A63B 37/00* (2006.01)
*C08B 18/44* (2006.01)

(52) U.S. Cl. ..... 528/85; 525/467; 473/385; 473/378

(58) Field of Classification Search ..... None
See application file for complete search history.

(56) References Cited

U.S. PATENT DOCUMENTS

| | | | | |
|---|---|---|---|---|
| 5,070,173 | A | 12/1991 | Yokota et al. | |
| 5,661,207 | A * | 8/1997 | Carlson et al. | 524/414 |
| 5,816,939 | A * | 10/1998 | Hamada et al. | 473/357 |
| 6,207,784 | B1 | 3/2001 | Rajagopalan | |
| 6,248,028 | B1 | 6/2001 | Higuchi et al. | |
| 6,476,176 | B1 | 11/2002 | Wu | |
| 6,645,088 | B2 | 11/2003 | Wu et al. | |
| 6,846,898 | B2 | 1/2005 | Yokota | |
| 6,855,793 | B2 | 2/2005 | Harris et al. | |
| 6,958,380 | B2 | 10/2005 | Risen, Jr. et al. | |
| 2002/0173379 | A1 | 11/2002 | Wu et al. | |
| 2003/0153716 | A1 * | 8/2003 | Wu et al. | 528/60 |
| 2004/0082406 | A1 | 4/2004 | Wu et al. | |
| 2004/0254298 | A1 * | 12/2004 | Kim et al. | 525/92 C |
| 2007/0072701 | A1 | 3/2007 | Nagasawa | |
| 2007/0073031 | A1 * | 3/2007 | Nagasawa et al. | 528/85 |

FOREIGN PATENT DOCUMENTS

| | | | |
|---|---|---|---|
| JP | 05032756 | * | 2/1993 |
| JP | 05043647 | * | 2/1993 |
| JP | 05051428 | * | 3/1993 |
| JP | 5-29648 | B2 | 5/1993 |
| JP | 09262319 | * | 10/1997 |
| JP | 2002-521157 | A | 7/2002 |
| JP | 2002-272878 | A | 9/2002 |
| JP | 2002-275234 | * | 9/2002 |
| JP | 2002-275803 | * | 9/2002 |
| JP | 2003-25366 | A | 1/2003 |
| JP | 2003-327652 | A | 11/2003 |
| JP | 2005-000662 | * | 1/2005 |
| JP | 2005-532436 | A | 10/2005 |

OTHER PUBLICATIONS

Machine translation of JP2003327652.*
Machine translation of JP2003327652, No date.*
Japanese Office Action; 2006-353255 of Jun. 2, 2009 and translation; p. 1-4.

* cited by examiner

*Primary Examiner* — David Buttner
(74) *Attorney, Agent, or Firm* — Birch, Stewart, Kolasch & Birch, LLP

(57) ABSTRACT

The object of the present invention is to provide a golf ball which is even more excellent in abrasion-resistance, durability and moldability by using a polyurethane ionomer having a novel structure as a base resin of a cover. The golf ball of the present invention has a cover, and the cover comprises, as a base resin, a polyurethane ionomer containing a polycarbonate polyol as a constitutional component.

10 Claims, No Drawings

GOLF BALL

FIELD OF THE INVENTION

The present invention relates to a golf ball having a polyurethane ionomer cover, more specifically to a golf ball having a thermoplastic polycarbonate-polyurethane ionomer cover.

DESCRIPTION OF THE RELATED ART

As a base resin constituting a cover of a golf ball, an ionomer resin or polyurethane is used. Covers containing ionomer resins are widely used for their excellent resilience, durability, workability and the like. However, because of their high rigidity and hardness, problems such as a bad shot feeling, inadequate spin performance and poor controllability are pointed out. Polyurethane is roughly classified into thermoplastic polyurethane and thermosetting polyurethane. Although a thermosetting polyurethane is a highly excellent material in terms of shot feeling, spin performance and abrasion-resistance, a molding process thereof becomes complicated. On the other hand, although a thermoplastic polyurethane is excellent in moldability, it has a problem of poor abrasion-resistance.

In order to solve such problems, a polyurethane ionomer is proposed as a base resin of a polyurethane cover (e.g., Published Japanese translation of PCT application No. 2002-521157, Published Japanese translation of PCT application No. 2005-532436). Published Japanese translation of PCT application No. 2002-521157 discloses a golf ball comprising a cover including at least one cover layer and a core layer including at least one core layer, wherein at least either the cover layer or the core layer is formed of a composition containing at least one anionic polyurethane or polyurea ionomer, or a copolymer thereof. Published Japanese translation of PCT application No. 2005-532436 discloses a golf ball containing one or more compounds prepared by a method that comprises a) a step of forming an isocyanate-terminated polyurethane prepolymer by reacting a diisocyanate compound with a polyol compound in a solvent; and b) a step of forming a polyurethane ionomer by reacting the isocyanate-terminated polyurethane prepolymer with a finely segmented substantially anhydrous metal salt of acid-containing polyol in a solvent.

SUMMARY OF THE INVENTION

Even a conventional polyurethane ionomer such as one disclosed in Published Japanese translation of PCT application No. 2002-521157 and Published Japanese translation of PCT application No. 2005-532436 still has a room for improvement of abrasion-resistance. The present invention has been achieved in view of the above circumstances. An object of the present invention is to provide a golf ball which is even more excellent in abrasion-resistance, durability, and moldability by using a polyurethane ionomer having a novel structure as a base resin of a cover.

The present invention provides a golf ball having a cover, and the cover comprises, as a base resin, a polyurethane ionomer containing a polycarbonate polyol as a constitutional component. The polyurethane ionomer is characterized in that it forms an ionic bond under a room temperature and has a three-dimensional network structure like the thermosetting polyurethane, while in a high temperature, an ionic bond therein becomes dissociated so that it is capable of being fluid. Namely, in a room temperature, it exhibits high abrasion-resistance and durability like the thermosetting polyurethane, while in a high temperature, it is capable of being subjected to injection molding and compression molding like the thermoplastic polyurethane and is excellent in moldability. In the present invention, the abrasion-resistance and durability of the resultant polyurethane ionomer cover will be further improved by employing the polyurethane ionomer comprising the polycarbonate polyol as a constitutional component as the base resin of the cover.

The polycarbonate polyol preferably has, as a repeating constitutional unit, a repeating unit (A) and a repeating unit (B) having a different structure from that of (A) wherein a molar ratio of (A)/(B) is 30/70 to 70/30, the repeating unit (A) represented by a following formula (I) and the repeating unit (B) represented by a following formula (II):

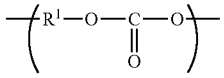

(I)

wherein $R^1$ is a bivalent residue obtained by removing two hydroxyl groups from a diol having 4 to 6 carbon atoms; and

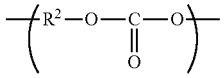

(II)

wherein $R^2$ is a bivalent residue obtained by removing two hydroxyl groups from a diol having 4 to 6 carbon atoms.

As the polycarbonate polyol, if a polycarbonate polyol having two different kinds of repeating units is used, crystallinity of the resultant polyurethane ionomer will not become too high, and while since it has the repeating unit having 4 to 6 carbon atoms, crystallinity thereof will not be too low. As a result, the obtained polyurethane ionomer has a good mechanical property, and the obtained polyurethane cover has a further improved abrasion-resistance and durability.

As the polycarbonate polyol, one in which $R^1$ is a bivalent residue obtained by removing two hydroxyl groups from 1,4-butanediol, 1,5-pentanediol, or 1,6-hexanediol is preferably used.

A content of a component containing an acidic group in the polyurethane ionomer is preferably from 0.27 mass % to 4.5 mass %. If the content of the component having the acidic group is not within the above range, the durability may be lowered. The polyurethane ionomer is preferably neutralized with a metal. A degree of neutralization of the polyurethane ionomer is preferably from 30 mol % to 100 mol %.

The present invention provides the golf ball having the urethane cover which is excellent in abrasion-resistance and, additionally, in durability and moldability. The present invention further provides a golf ball which is excellent in resilience and shot feeling.

DESCRIPTION OF THE PREFERRED EMBODIMENT

The present invention provides a golf ball having a cover, and the cover comprises a polyurethane ionomer containing a polycarbonate polyol as a constitutional component. First, the polyurethane ionomer containing the polycarbonate polyol as the constitutional component used in the present invention will be explained.

The polyurethane ionomer to be used in the present invention is not particularly limited as long as it is the thermoplastic polyurethane comprising the polycarbonate polyol as the constitutional component and having a plurality of urethane bonds in a molecule, wherein the acidic group included in the polyurethane is ionized by neutralization.

Herein, "polyurethane" is, for example, a reaction product by reacting a polyisocyanate and a polyol to form urethane bonds in a molecule thereof, and, if necessary, is obtained by a further chain extension reaction with a polyol and a polyamine having a low-molecular weight and the like. A "Polycarbonate polyol", which is well known to those skilled in the art, is a compound having a plurality of terminal hydroxyl groups, where the low-molecular weight diol components and the like are bonded via a carbonate bond.

The polycarbonate polyol (preferably polycarbonate diol) constituting the polyurethane ionomer of the present invention is not particularly limited as long as, for example, it is a polyol having a plurality of terminal hydroxyl groups and a structure represented by a following formula:

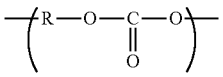

(III)

wherein R is, for example, a bivalent residue obtained by removing two hydroxyl groups from a diol such as 1,5-pentanediol, 1,6-hexanediol, 1,7-heptane diol, 1,8-octane diol, 2-ethyl-1,6-hexanediol, 3-methyl-1,5-pentanediol,neopentyl glycol, 1,3-cyclohexane diol, 1,4-cyclohexane diol, 2,2-bis (4-hydroxy cyclo hexyl)-propane, 1,4-dimethylol cyclohexane, dipropylene glycol, polytetramethylene glycol.

In the present invention, as the polycarbonate polyol, one having, as the repeating constitutional unit, a repeating unit (A) represented by a following formula (I) and a repeating unit (B) having a different structure from that of the repeating unit (A) represented by a following formula (II) wherein a molar ratio of (A)/(B) is from 30/70 to 70/30, more preferably from 40/60 to 60/40, even more preferably 50/50 is desirably used. If the molar ratio of either (A) or (B) becomes too high, crystallinity of the polycarbonate polyol becomes too high so that abrasion-resistance of the resultant polyurethane ionomer cover may be lowered.

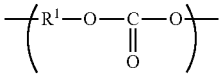

(I)

In the formula, $R^1$ is a bivalent residue obtained by removing two hydroxyl groups from a diol having 4 to 6 carbon atoms.

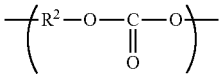

(II)

In the formula, $R^2$ is a bivalent residue obtained by removing two hydroxyl groups from a diol having 4 to 6 carbon atoms.

Herein, $R^1$ of the repeating unit (A) and $R^2$ of the repeating unit (B) are not limited if each of them is a bivalent residue obtained by removing two hydroxyl groups from a diol having 4 to 6 carbon atoms and if they are different from each other. Employing different structures for the structures of $R^1$ and $R^2$ prevents crystallinity of the polycarbonate polyol from becoming too high.

Examples of the diol having 4 to 6 carbon atoms may include 1,2-butanediol, 1,3-butanediol, 1,4-butanediol, 1-methyl-1,3-propanediol, and 2-methyl-1,3-propanediol as the diol having 4 carbon atom; 1,2-pentanediol, 1,3-pentanediol, 1,4-pentanediol, 1,5-pentanediol, 1,2-cyclo pentanediol, 1,3-cyclopentanediol, 1,1-dimethyl-1,3-propanediol, 2,2-dimethyl-1,3-propanediol, 1,3-dimethyl-1,3-propanediol, 1-ethyl-1,3-propanediol, 2-ethyl-1,3-propanediol, 1-methyl-1,4-butanediol, 2-methyl-1,4-butanediol and the like as the diol having 5 carbon atoms; and 1,2-hexanediol, 1,3-hexanediol, 1,4-hexanediol, 1,5-hexanediol, 1,6-hexanediol, 1,4-cyclohexane diol, methyl pentanediol, dimethyl butanediol, ethyl butanediol, trimethyl propanediol, methylethyl propanediol and the like as the diol having 6 carbon atoms.

As the polycarbonate polyol, a preferred example include a polycarbonate polyol wherein $R^1$ is a bivalent residue obtained by removing two hydroxyl groups from 1,4-butanediol, 1,5-pentanediol, or 1,6-hexanediol. More preferably, it is a polycarbonate polyol wherein $R^1$ is a bivalent residue obtained by removing two hydroxyl groups from 1,4-butanediol and $R^2$ is a bivalent residue obtained by removing two hydroxyl groups from 1,6-hexanediol, or a polyol wherein $R^1$ is a bivalent residue obtained by removing two hydroxyl groups from 1,5-pentanediol and $R^2$ is a bivalent residue obtained by removing two hydroxyl groups from 1,6-hexanediol.

In addition to the repeating unit (A) shown in the formula (I) above and the repeating unit (B) shown in the formula (II) above, the polycarbonate polyol used in the present invention may further contain a third repeating constitutional unit as the repeating constitutional unit, as long as the effects of the present invention are not undermined. However, it is most preferable that the polycarbonate polyol essentially consists of the repeating units (A) and (B) as the repeating constitutional unit.

The polycarbonate polyol which constitutes the polyurethane ionomer used in the present invention preferably has a weight average molecular weight of 1,000 or more, more preferably 1,500 or more, even more preferably 2,000 or more, and preferably has a weight average molecular weight of 4,000 or less, more preferably 3,500 or less, even more preferably 3,000 or less.

As the polyol component constituting the polyurethane ionomer used in the present invention, in addition to the polycarbonate polyol, a general-purpose polyol may be used in combination as long as the effects of the present invention are not undermined. Examples of the general-purpose polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); and an acrylic polyol. The above polyols may also be used as a mixture of at least two of them. The general-purpose polyol preferably has a weight average molecular weight ranging from 400 to 10,000.

The polyisocyanate component which constitutes the polyurethane ionomer used in the present invention is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, an aromatic polyisocyanate is preferably used as the polyisocyanate component of the polyurethane. A use of the aromatic polyisocyanate improves a mechanical property of the obtained polyurethane ionomer and provides the cover with even more excellent abrasion-resistance. In addition, as the polyisocyanate component of the polyurethane ionomer, a non-yellowing type polyisocyanate such as TMXDI, XDI, HDI, $H_6$XDI, IPDI, $H_{12}$MDI and NBDI is preferably used in view of improving the weather resistance. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane ionomer is improved, and thus the cover which is excellent in abrasion-resistance can be obtained.

The polyurethane ionomer used in the present invention comprises a component containing an acidic group as a constitutional component, wherein the acidic group is ionized by neutralization. Examples of the component containing the acidic group may include a component containing a carboxyl group such as dimethylol propionic acid, dimethylol butanoic acid, dihydroxypropionic acid, and dihydroxysuccinic acid; and a component containing a sulfonate group such as 1,3-di(hydroxy methyl)-5-sulfo-diisophthalate, 1,3-di(2-hydroxy ethyl)-5-sulfo-diisophthalate, 1,3-di(3-hydroxy propyl)-5-sulfo-diisophthalate, 1,3-di(4-hydroxy-n-butyl)-5-sulfo-diisophthalate, 1,3-di(5-hydroxy-n-pentyl)5-sulfo-diisophthalate, and 1,3-di(6-hydroxy-n-hexyl)-5-sulfo-diisophthalate. Among them, the component containing the carboxyl group such as dimethylol propionic acid and dimethylol butanoic acid is preferred.

A content of the component containing the acidic group is preferably 0.27 mass % or more, more preferably 0.3 mass % or more, and preferably 4.5 mass % or less, more preferably 3.9 mass % or less in the polyurethane ionomer. If the content of the component containing the acidic group becomes too high, the durability becomes poor, while if the content becomes too low, an improving effect on the abrasion-resistance becomes small.

Additionally, the polyurethane ionomer used in the present invention is preferably neutralized with a metal. The metal is not particularly limited as long as it can neutralize an acidic group, but it is preferably, for example, a metal, having an atomic radius of 0.85 Å to 1.54 Å. A metal having an atomic radius of 0.85 Å to 1.54 Å has a less exothermic amount when neutralizing the acidic group, so that the polyurethane ionomer will be easily synthesized. Further, it is also a more preferred embodiment to make the atomic radius 0.89 Å to 1.36 Å. Molding of the resultant golf ball will be easier by using the metal having an atomic radius of 0.89 Å to 1.36 Å. Examples of the metal having an atomic radius of 0.85 Å to 1.54 Å include Li, Na, Mg, Al, and Zn. It is preferred to use an acetic acid salt and a carbonate salt of the above metals and the like when neutralizing the acidic group of the polyurethane.

A degree of neutralization of the polyurethane ionomer used in the present invention is preferably 30 mol % or more, more preferably 60 mol % or more. If the degree of neutralization is 30 mol % or more, a crosslinking density of the polyurethane ionomer by an ionic bond will be enhanced, so that the polyurethane ionomer excellent in mechanical property can be obtained. As a result, the polyurethane ionomer cover which is excellent in the resilience and durability can be obtained. An upper limit of the degree of neutralization is not particularly limited, and it may be 100 mol %. However, if the degree of neutralization becomes too high, the durability may be lowered. Therefore, the upper limit of the degree of neutralization is preferably 90 mol %, more preferably 85 mol %. In a case of neutralizing the carboxyl group using a bivalent metal, two carboxyl groups are neutralized with one bivalent metal.

Each of the content and the degree of neutralization of the component containing the acidic group are defined by following formulas.

Content of the component containing the acidic group (mass %)=100×(mass of the component containing the acidic group)/(a total mass of the polyurethane ionomer; however, it does not include a mass of the metal)

Degree of neutralization (mol %)=100×(the number of moles of the ionized acidic group among the acidic group introduced into the polyurethane ionomer)/(a total number of moles of the acidic group introduced into the polyurethane ionomer)

The polyurethane ionomer used in the present invention, if necessary, may comprise a chain extender component as a constitutional component. Examples of a polyol having a low-molecular weight which can be used as the chain extender include a diol such as ethylene glycol, diethylene glycol, triethylene glycol, 1,3-butanediol, 1,4-butanediol, neopentyl glycol, and 1,6-hexanediol; and a triol such as glycerin, trimethylol propane and hexanetriol. The polyamine having a low-molecular weight which can be used as the chain extender is not particularly limited as long as it has 2 or more amino groups. The polyamine may include an aliphatic polyamine such as ethylenediamine, propylenediamine, butylene diamine, hexamethylenediamine, an alicyclic polyamine such as isophoronediamine and piperazine, an aromatic polyamine and the like.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly(aminobenzene) having two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane and the derivatives thereof.

The polyurethane ionomer containing the polycarbonate polyol as the constitutional component used in the present invention has no limitation on the constitutional embodiments thereof. Examples of the constitutional embodiments are the embodiment where the polyurethane consists of the polyisocyanate component, the polycarbonate polyol component and the component containing an acidic group; the embodiment where the polyurethane consists of the polyisocyanate component, the polycarbonate polyol component, the component containing an acidic group and the low-molecular weight polyol component; the embodiment where the polyurethane consists of the polyisocyanate component, the polycarbonate polyol component, the component containing an acidic group, the low-molecular weight polyol component and the polyamine component; and the embodiment where the polyurethane consists of the polyisocyanate component, the polycarbonate polyol component, the component containing an acidic group and the polyamine component.

The polyurethane ionomer preferably has the slab hardness of 20 or more, more preferably 24 or more, even more preferably 26 or more, and preferably has the slab hardness of 70 or less, more preferably 66 or less, even more preferably 60 or less in shore D hardness. If the hardness in Shore D hardness is less than 20, the flying distance may be lowered due to the lowered resilience of the resultant golf ball. On the other hand, if the hardness is more than 70, the durability of the obtained golf ball may be lowered. The slab hardness of the polyurethane ionomer can be measured by forming the polyurethane ionomer into sheets having a thickness of about 2 mm by hot press molding, keeping the sheets for two weeks at the temperature of 23° C., and stacking three or more of the sheets on one another to avoid being affected by the measuring substrate on which the sheets were placed for measurement using the Shore D type spring hardness tester prescribed by ASTM-D2240.

A method for producing the polyurethane ionomer containing the polycarbonate polyol as the constitutional component used in the present invention includes, for example, a prepolymer method comprising preparing a prepolymer by reacting the polyisocyanate with the polycarbonate polyol, further reacting the resultant prepolymer with the component containing the acidic group to obtain the polyurethane containing an acidic group, and neutralizing the acidic group of the resultant polyurethane with a metal salt; or one shot method comprising reacting the polyisocyanate, the polycarbonate polyol and the component containing an acidic group to obtain the polyurethane containing an acidic group followed by neutralizing the acidic group of the resultant polyurethane with a metal salt. In the present invention, it is a preferred embodiment to first obtain a polyurethane having a high molecular weight containing an acidic group, and then to neutralize the acidic group of the resultant polyurethane with a metal salt. Additionally, in synthesizing and neutralizing the polyurethane ionomer, a catalyst, solvent and the like may be suitably used where necessary.

The golf ball cover of the present invention is not particularly limited as long as it comprises, as a base resin, the above described polypolyurethane ionomer containing the carbonate polyol as the constitutional component. For example, it preferably contains the polyurethane ionomer in an amount of 50 parts by mass or more, more preferably 60 parts by mass or more, even more preferably 70 parts by mass or more in 100 parts by mass of the base resin. Additionally, it is also a preferred embodiment to use the polyurethane ionomer alone as the base resin.

The resin component, which may be used in combination with the polyurethane ionomer, include a thermoplastic polyamide elastomer having a commercial name of "PEBAX" such as "PEBAX 2533" available from ARKEMA Inc., a thermoplastic polyester elastomer having a commercial name of "HYTREL" such as "HYTREL 3548" and "HYTREL 4047" available from DU PONT-TORAY Co., a thermoplastic polyurethane elastomer having a commercial name of "ELASTOLLAN" such as "ELASTOLLAN XNY97A" available from BASF Polyurethane Elastomers, a thermoplastic polystyrene elastomer having a commercial name of "Rabalon" available from Mitsubishi Chemical Co., as well as the conventional ionomer resin.

The golf ball cover of the present invention may contain, in addition to the above mentioned base resin, a pigment component such as zinc oxide, titanium oxide, and a blue pigment, a gravity adjusting agent such as calcium carbonate and barium sulfate, a dispersant, an antioxidant, an ultraviolet absorber, a light stabilizer, a fluorescent material or fluorescent brightener and the like as long as the cover performance is not undermined.

The content of the white pigment (titanium oxide) is preferably 0.5 part by mass or more, more preferably 1 part by mass or more, and preferably 10 parts by mass or less, more preferably 8 parts by mass or less based on 100 parts by mass of the base resin constituting the cover. The white pigment in an amount of 0.5 part by mass or more can impart opacity to the cover, while the white pigment in an amount of more than 10 parts by mass may lower the durability of the resulting cover.

In the present invention, the golf ball preferably has the polyurethane ionomer cover with a thickness of 2.0 mm or less, more preferably 1.6 mm or less, even more preferably 1.0 mm or less. If the thickness is 2.0 mm or less, the outer diameter of the core can be increased, thus the resilience is enhanced. The lower limit of the thickness of the polyurethane ionomer cover is, for example, but not limited to 0.1 mm. If the thickness is less than 0.1 mm, the molding of the polyurethane ionomer cover may become difficult.

The polyurethane ionomer cover preferably has the slab hardness of 20 or more, more preferably 24 or more, even more preferably 26 or more, and preferably has the slab hardness of 70 or less, more preferably 66 or less, even more preferably 60 or less in shore D hardness. If the cover hardness is less than 20, the flying distance may be lowered due to the lowered resilience of the resultant golf ball. On the other hand, if the cover hardness is more than 70, the durability of the obtained golf ball may be lowered. The slab hardness of the cover can be measured by forming the cover composition into sheets having a thickness of about 2 mm by hot press molding, keeping the sheets for two weeks at the temperature of 23° C., and stacking three or more of the sheets on one another to avoid being affected by the measuring substrate on which the sheets were placed for measurement using the Shore D type spring hardness tester prescribed by ASTM-D2240.

The present invention is preferably applied to a golf ball having a cover, and may be applied to any of the following: a two-piece golf ball having a core and a cover covering the core; a three-piece golf ball having a core, an intermediate layer covering the core and a cover covering the intermediate layer; a multi-piece golf ball consisting of at least four layers; and a wound golf ball having a wound core and a cover. In a three-piece golf ball or a multi-piece golf ball, when the intermediate layer is regarded as a part of the core, it may be referred to as the multi-layer core, while when the intermediate layer is regarded as a part of the cover, it may be referred to as a multi-layer cover.

A core of the golf ball of the present invention, for example, without limitation, is preferably a molded body, preferably a spherical core, which is formed by heat-pressing a rubber composition. The rubber composition for the core comprises, for example, a base rubber, a crosslinking initiator, a co-crosslinking agent, and, if necessary, a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the organic peroxide to be blended in the rubber composition is preferably 0.2 part by mass or more, more preferably 0.3 part by mass or more, and preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the amount of co-crosslinking agent needs to be increased in order to obtain an appropriate hardness, so that the resilience tends to be insufficient.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts by mass or more, more preferably 20 parts by mass or more, and preferably 50 parts by mass or less, more preferably 40 parts by mass or less relative to 100 parts by mass of the base rubber. If the amount of the co-crosslinking agent to be used is less than 10 parts by mass, the amount of the organic peroxide must be increased to obtain an appropriate hardness which tends to lower the resilience. On the other hand, if the amount of the co-crosslinking agent to be used is more than 50 parts by mass, the core becomes too hard, so that the shot feeling may be lowered.

The filler contained in the rubber composition for the core is mainly one blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts by mass or more, more preferably 3 parts by mass or more, and preferably 50 parts by mass or less, more preferably 35 parts by mass or less based on 100 parts by mass of the base rubber. If the amount of filler to be blended is less than 2 parts by mass, it becomes difficult to adjust the weight, while if it is more than 50 parts by mass, the weight ratio of the rubber component becomes small and the resilience tends to be lowered.

As the rubber composition for the core, in addition to the base rubber, the crosslinking initiator, the co-crosslinking agent and the filler, an organic sulfur compound, an antioxidant or a peptizing agent may be blended as appropriate.

As the organic sulfur compound, a diphenyl disulfide or a derivative thereof may be preferably used. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber. Examples of the diphenyl disulfide or the derivative thereof include diphenyl disulfide; a monosubstituted diphenyl disulfide such as bis (4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a disubstituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; trisubstituted diphenyl disulfide such as bis(2,4,6-trichlorophenyl)disulfide, and bis (2-cyano-4-chloro-6-bromophenyl)disulfide; a tetra substituted diphenyl disulfide such as bis(2,3,5,6-tetra chlorophenyl)disulfide; a penta substituted diphenyl disulfide such as bis(2,3,4,5,6-pentachlorophenyl)disulfide and bis(2,3,4,5,6-penta bromophenyl)disulfide. These diphenyl disulfides can enhance resilience by having some influence on the state of vulcanization of vulcanized rubber. Among them, diphenyl disulfide and bis(penta bromophenyl)disulfide are preferably used since a golf ball having particularly high resilience can be obtained.

The amount of the antioxidant to be blended is preferably 0.1 part by mass or more and 1 part by mass or less based on 100 parts by mass of the base rubber. Further, the peptizing agent is preferably 0.1 part by mass or more and 5 parts by mass or less based on 100 parts by mass of the base rubber.

The conditions for press-molding the rubber composition for core may be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

The diameter of the core is preferably 30 mm or more, more preferably 32 mm or more, and preferably 41 mm or less, more preferably 40.5 mm or less. If the diameter of the core is less than 30 mm, the thickness of the intermediate layer or the cover needs to be greater than the desired thickness, possibly resulting in lowered resilience. On the other hand, if the diameter of the core is more than 41 mm, the thickness of the intermediate layer or the cover needs to be less than a desired thickness, so the function of the intermediate layer or the cover cannot be obtained sufficiently.

The core, if it has a diameter of 30 mm to 41 mm, preferably has a compression deformation amount (an amount the golf ball shrinks along the direction of the compression) of 2.5 mm or more, more preferably 3.4 mm or more and preferably has a compression deformation amount of 5.0 mm or less, more preferably 4.5 mm or less when applying a load from 98 N as an initial load to 1275 N as a final load. If the compression deformation amount is less than 2.5 mm, the shot feeling becomes bad due to hardness, while if it is more than 5.0 mm, the resilience may be lowered.

It is also a preferred embodiment to use, as the core, a core having a difference of hardness between a center and a surface of the core. The difference between the surface hardness and the center hardness in accordance with JIS-C hardness is preferably 10 or more, more preferably 12 or more, and preferably 40 or less, more preferably 35 or less, even more preferably 30 or less. If the difference of the hardness is more than 40, the durability is lowered, while if the difference of the hardness is less than 10, the shot feeling is so hard that an impact of a shot may become larger. The surface hardness of the core in accordance with JIS-C hardness is preferably 65 or more, more preferably 70 or more, even more preferably 72 or more, and preferably 85 or less. If the surface hardness of the core in accordance with JIS-C hardness is less than 65, the golf ball becomes too soft, so that the resilience thereof is lowered, resulting in lowering of flying distance. On the other hand, if the surface hardness of the core is more than 85, the golf ball becomes too hard, so that the shot feeling may become poor. The center hardness of the core in accordance with JIS-C hardness is preferably 45 or more, more preferably 50 or more, and preferably 70 or less, more preferably 65 or less. If the center hardness of the core is less than 45, the golf ball becomes too soft, so that the durability may be lowered. If the center hardness of the core is more than 70, the golf ball becomes too hard, so that the shot feeling thereof may become poor. The difference of the hardness of the core can be set by suitably selecting conditions of heat molding.

Hereinafter, a method for preparing the golf ball of the present invention will be described based on embodiments of a two-piece golf ball. However, the present invention is not limited to the method.

First, the rubber composition for the core is mixed and kneaded to mold it into a spherical core in a mold. Conditions for molding the spherical core are not particularly limited, but usually the molding is carried out at 130 to 180° C., under a pressure of 2.9 to 11.8 MPa for 10 to 40 minutes. Next, the core is covered with the cover composition containing the above described polyurethane ionomer to prepare a golf ball. The method of molding the cover is not limited. Examples of the method include the method which comprises molding the cover composition into hemispherical half shells beforehand, covering the core using two half shells, and subjecting the core with two half shells to the pressure molding for 1 to 5 minutes at a temperature of 130 to 170° C., and the method which comprises injection-molding the cover composition directly onto the core to form a cover. Further, when forming the cover to obtain a golf ball body, the cover can be formed with a plurality of concavities, which are so called "dimple", at the surface thereof. As required, the surface of the golf ball can be subjected to grinding treatment such as sandblast in order to enhance the adhesion of the mark and the paint film.

The present invention can be applied to a wound golf ball. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of natural rubber and a synthetic polyisoprene, a sulfur, a vulcanization auxiliary agent, a vulcanization accelerator, and an antioxidant. The rubber thread is wound around the center in elongation of about 10 times length to form the wound core.

When preparing a three-piece golf ball or a multi-piece golf ball, as the intermediate layer, for example, a thermoplastic polyamide elastomer having a commercial name of "PEBAX", for example, "PEBAX 2533", available from ARKEMA Inc; a thermoplastic polyester elastomer having a commercial name of "HYTREL", for example, "HYTREL 3548" and "HYTREL 4047" available from DU PONT-TORAY Co.; a thermoplastic polyurethane elastomer having a commercial name of "ELASTOLLAN", for example, "ELASTOLLAN XNY97A" available from BASF Japan; and a thermoplastic polystyrene elastomer having a commercial name of Rabalon" available from Mitsubishi Chemical Co. may be used, in addition to the cured product of the rubber composition and the conventional ionomer resins. Examples of the ionomer resin include an ionomer resin prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Specific examples of the ionomer resins include, but not limited to, Himilan 1555 (Na), Himilan 1557 (Zn), Himilan 1605 (Na), Himilan 1706 (Zn), Himilan 1707 (Na), Himilan AM7311 (Mg), and examples of the ternary copolymer ionomer resin include Himilan 1856 (Na) and Himilan 1855 (Zn) available from MITSUI-DUPONT POLYCHEMICAL CO., LTD.

Further, ionomer resins available from DUPONT CO. include Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn and AD8546 (Li), and examples of the ternary copolymer ionomer resin include Surlyn 8120 (Na), Surlyn 8320 (Na), Surlyn 9320 (Zn), and Surlyn 6320 (Mg).

Ionomer resins such as Iotek 8000 (Na), Iotek 8030 (Na), Iotek 7010 (Zn), and Iotek 7030 (Zn) are available from Exxon Mobil Chemical Company. Examples of the ternary copolymer ionomer resin include Iotek 7510 (Zn) and Iotek 7520 (Zn).

Na, Zn, K, Li, or Mg described in the parentheses after the commercial name of the ionomer resin represents a kind of metal used for neutralization. The intermediate layer may further contain a gravity adjusting agent such as barium sulfate and tungsten, an antioxidant, a pigment and the like.

The golf ball of the present invention is preferably formed with a paint film, more preferably a single layer paint film. If the golf ball is provided with the paint film, appearance of the golf ball can be improved and, at the same time, deterioration of the polyurethane ionomer can be prevented. As the paint film, for example, a polyurethane paint film and an epoxy paint film are preferred.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Abrasion-Resistance

A commercially available pitching wedge was installed on a swing robot available from Golf Laboratories, Inc., and two points of a ball respectively were hit once at the head speed of 36 m/sec. The portions which were hit were observed, evaluated and ranked into five levels based on following criteria.

5 points: No scratch was present, or scratches were hardly conspicuous.

4 points: A few scratches could be observed, but were barely annoying.

3 points: A little scuffing was present on the surface.

2 points: Scuffing or a lack of dimples was observed on the surface.

1 point: Dimples had been completely scraped away.

(2) Durability

Each golf ball was repeatedly hit with a metal head driver (XXIO3, loft: 9 degrees, shaft: S) attached to a swing robot manufactured by TRUETEMPER CO, at the head speed of 55 m/sec. to measure times up to which the golf balls are cracked. The golf balls after being hit were visually observed, and were judged to be cracked when a scar having a size of 2 mm or more was found.

Evaluation Standard

Excellent (E): The number of times the golf balls were cracked was 50 times or more;

Fair (F): The number of times the golf balls were cracked was in a range of 40 times to 50 times (exclusive); and Poor (P): The number of times the golf balls were cracked was less than 40 times.

(3) Moldability

A golf ball having no problem on an appearance thereof after being press-molded was evaluated as "Excellent". A golf ball which had no problem on an appearance thereof but was adhesive and thus was difficult to remove from the mold was evaluated as "Fair". A golf ball having a problem on an appearance was evaluated as "Poor".

(4) Slab Hardness (Shore D Hardness)

Using the cover composition, a sheet having a thickness of about 2 mm were prepared by hot press molding and preserved at the temperature of 23° C. for two weeks. Three or more of the sheets were stacked on one another to avoid being affected by the measuring substrate on which the sheets were placed, and the stack was subjected to the measurement using P1 type auto hardness tester provided with the Shore D or Shore A type spring hardness tester prescribed by ASTM-D2240, available from KOUBUNSHI KEIKI CO., LTD.

(5) Compression Deformation Amount (mm)

The compression deformation amount (amount the golf ball shrinks along the compression direction: mm) of the golf balls or the cores was measured when applying a load from 98 N (10 kgf) as an initial load to 1275 N (130 kgf) as a final load to the golf balls or the cores.

(6) Core Hardness

JIS-C hardness obtained by measuring a surface part of the spherical core using C type spring hardness tester specified by JIS-K 6301 was determined as the surface hardness, and JIS-C hardness measured by cutting a spherical core into hemispherical shape to measure a center of a cut surface thereof was determined as the center hardness of the core.

(7) Shot Feeling

Actual hitting test was carried out by ten golfers including two professional golfers and eight high-level amateur golfers (handicap of 5 or less) with a metal head driver (W#1). The shot feeling in terms of resilience was evaluated based on the following criteria. Major result of the results provided by the ten golfers was regarded as the shot feeling of the golf ball.

Excellent (E): The shot feeling of the golf ball is good with resilience.

Fair (F): Normal

Poor (P): The shot feeling is bad, with a heavy feeling and weak resilience.

(8) Repulsion Coefficient of Golf Ball

An aluminum cylinder having a weight of 200 g was collided with each golf ball at the speed of 45 m/sec to measure the speed of the cylinder and each of the golf balls before and after the collision to calculate the repulsion coefficient of each golf ball from the speed and the weight thereof. The measurement was carried out five times for each golf ball, and the average was taken as the repulsion coefficient of the golf ball. Each value of the repulsion coefficient was reduced to an index number relative to the value of golf ball No. 3 being assumed 100. The larger index number indicates better resilience.

[Preparation of Polyurethane Ionomer]

Polycarbonate polyol or polytetramethylene ether glycol and diisocyanate shown in Table 1 were fed into a flask and stirred under a nitrogen atmosphere at 60° C. for 3 hours, thereby preparing a prepolymer. Next, dimethylol butanoic acid as an acidic group-containing component and, where necessary, propane diol were dissolved in fiftyfold amount by mass of N,N-dimethyl acetamide(N,N-dimethyl acetamide (dehydrated) manufactured by Wako Pure Chemical Industries, Ltd.). The obtained solution was dropped into the prepolymer using a dropping funnel for 20 minutes. Then, the mixture was stirred at 60° C. for 2 hours to carry out a chain extension reaction, thereby obtaining carboxyl group-containing polyurethane. Magnesium acetate tetrahydrate (magnesium acetate tetrahydrate manufactured by Wako Pure Chemical Industries, Ltd.) was dissolved into 10 times by mass of methanol (methanol manufactured by Wako Pure Chemical Industries, Ltd., dehydrated), and the mixture was dropped into the carboxyl group-containing polyurethane using a dropping funnel for 1 minute. Then the mixture was stirred for 1 hour under the above conditions to carry out polymerization termination reaction and neutralization reaction, thereby obtaining a polyurethane ionomer solution. The resultant polyurethane ionomer solution was vacuum-dried in a vacuum oven at 90° C. for 48 hours, thereby obtaining a polyurethane ionomer.

TABLE 1

| | Polyurethane | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| Molar ratio | — | — | — | — | — | — | — | — | — | — | — | — | — | — | — | — |
| PTG-2000SN | — | — | — | — | — | — | — | — | — | — | — | — | — | 1 | — | — |
| PCDL T5652 | — | 1 | 1 | 1 | 1 | 1 | 1 | 1 | 1 | — | — | 1 | 1 | — | — | — |
| PCDL T4672 | 1 | — | — | — | — | — | — | — | — | — | — | — | — | — | — | — |
| PCDL T4692 | — | — | — | — | — | — | — | — | — | 1 | — | — | — | — | 1 | — |

TABLE 1-continued

| | Polyurethane | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| PCDL T6002 | — | — | — | — | — | — | — | — | — | — | 1 | — | — | — | — | 1 |
| MDI | 4 | 4 | 4 | 4 | 4 | 4 | 4 | 4 | 4 | 4 | 4 | 4 | 5 | 4 | 4 | 4 |
| DMBA | 3 | 3 | 0.2 | 1 | 2 | 3 | 3 | 3 | 3 | 3 | 3 | 0.1 | 4 | 3 | — | — |
| PD | — | — | 2.8 | 2 | 1 | 0 | — | — | — | — | — | 2.9 | — | — | 3 | 3 |
| Properties | — | — | — | — | — | — | — | — | — | — | — | — | — | — | — | — |
| Acid content (mass %) | 3.9 | 3.9 | 0.3 | 1.4 | 2.7 | 3.9 | 3.9 | 3.9 | 3.9 | 3.9 | 3.9 | 0.1 | 4.7 | 3.9 | 0 | 0 |
| Degree of neutralization (mole %) | 75 | 75 | 75 | 75 | 75 | 30 | 60 | 90 | 100 | 75 | 75 | 75 | 75 | 75 | 0 | 0 |
| Neutralized metal | Mg | Mg | Mg | Mg | Mg | Mg | Mg | Mg | Mg | Mg | Mg | Mg | Mg | Mg | — | — |
| Shore D hardness | 60 | 57 | 26 | 41 | 47 | 22 | 43 | 60 | 66 | 60 | 62 | 24 | 68 | 61 | 23 | 22 |

Notes on Table 1

MDI: Sumidule 44S, 4,4'-diphenylmethane diisocyanate manufactured by Sumika Bayer Urethane Co., Ltd.

PTG-2000SN: polytetramethylene ether glycol having a number average molecular weight of 2000 manufactured by Hodogaya Chemical Co., LTD.

DMBA: dimethylol butanoic acid manufactured by Nippon Kasei Chemical Co., Ltd.

PD: 1,3-propanediol manufactured by Wako Pure Chemical Industries, Ltd.

As the polycarbonate diol, the one shown in Table 2 was used.

TABLE 2

| | Structure | | |
|---|---|---|---|
| Polycarbonate polyol | Diol compound of repeating unit A | Diol compound o repeating unit B | Molar ratio (A)/(B) |
| PCDL T5652 | 1,5-PD | 1,6-HD | 50/50 |
| PCDL T4672 | 1,4-BD | 1,6-HD | 70/30 |
| PCDL T4692 | 1,4-BD | 1,6-HD | 90/10 |
| PCDL T6002 | 1,6-HD | — | Component A: 100 |

"1,4-BD: 1,4-butanediol, 1,5-PD: 1,5-pentanediol, 1,6-HD: 1,6-hexanediol"

[Preparation of Three-Piece Golf Ball]

(1)Preparation of Core

The rubber composition for the core shown in Table 3 was kneaded, and was subjected to heat-pressing for 30 minutes in the upper and lower molds having a spherical cavity at the temperature of 140° C. to obtain a spherical core having a diameter of 38.5 mm and a mass of 34.9 g.

TABLE 3

| Core composition | Parts by mass |
|---|---|
| Polybutadiene rubber | 100 |
| Zinc acrylate | 37 |
| Zinc oxide | Appropriate amount*) |
| Bis(penta bromophenyl)disulfide | 0.7 |
| Dicumyl peroxide | 0.9 |

*)Formulation of the zinc oxide was suitably adjusted in accordance with the cover composition so that the mass of the golf ball became 45.4 g.

Notes on Table 3

Polybutadiene rubber: BR730 (high cis-polybutadiene) manufactured by JSR Corporation Zinc acrylate: ZNDA-90S manufactured by NIHON JYORYU KOGYO Co., LTD.

Zinc oxide: Ginrei R manufactured by Toho-Zinc Co.

Dicumyl peroxide: Percumyl D manufactured by NOF Corporation

The zinc oxide was suitably added so that a mass of the resultant golf ball became 45.4 g.

Next, as an ionomer resin, 50 parts by mass of "Himilan 1605" available from MITSUI-DUPONT POLYCHEMICAL and 50 parts by mass of "Surlyn 9945" available from DUPONT CO. were mixed in twin-screw kneading extruder to prepare the composition for an intermediate layer core in the form of the pellet. The extrusion was carried out under the following conditions: screw diameter=45 mm, screw revolutions=200 rpm, screw L/D=35. The material for the outer layer core was heated at a temperature between 150° C. and 230° C. at the die position of the extruder. The obtained material for the intermediate layer was directly injection-molded onto the core to prepare a multi layer core consisting of the inner layer core and the outer layer core (having a diameter of 41.7 mm).

(2) Preparation of Cover Composition

Using the polyurethane synthesized as described above, the cover composition shown in Table 4 was mixed in a twin-screw kneading extruder to prepare the cover composition into the form of the pellet. Extrusion was carried out in the following conditions: screw diameter of 45 mm, screw revolutions of 200 rpm, and screw L/D=35.

(3) Molding of Half Shell

The half shells were compression-molded by charging the cover composition in the form of the pellet obtained as described above into each of the depressed parts of the lower molds, and applying pressure to mold half shells. The compression-molding was carried out at the temperature of 160° C. for 5 minutes under the pressure of 100 kgf/cm$^2$.

(4) Molding of the Cover

The core obtained in (1) in which the intermediate layer was covered was covered with two half shells obtained in (3) and subjected to compression-molding to form the cover. The molding was carried out at the temperature of 140® C. for 3 minutes under the pressure of 100 kgf/cm$^2$. The surface of the obtained golf ball body was subjected to sandblast treatment and marking followed by coating a urethane clear paint, drying at the temperature of 40° C. in an oven to dry the paint to obtain a golf ball having a diameter of 42.7 mm and a weight of 45.4 g.

The obtained golf ball was evaluated in terms of the abrasion-resistance, durability and moldability. The results are shown in Table 4.

TABLE 4

| | Golf ball | | | | | | | | | | | | | | | |
|---|---|---|---|---|---|---|---|---|---|---|---|---|---|---|---|---|
| | No. 1 | No. 2 | No. 3 | No. 4 | No. 5 | No. 6 | No. 7 | No. 8 | No. 9 | No. 10 | No. 11 | No. 12 | No. 13 | No. 14 | No. 15 | No. 16 |
| Cover composition | — | — | — | — | — | — | — | — | — | — | — | — | — | — | — | — |
| Polyurethane 1 | 100 | — | — | — | — | — | — | — | — | — | — | — | — | — | — | — |
| Polyurethane 2 | — | 100 | — | — | — | — | — | — | — | — | — | — | — | — | — | — |
| Polyurethane 3 | — | — | 100 | — | — | — | — | — | — | — | — | — | — | — | — | — |
| Polyurethane 4 | — | — | — | 100 | — | — | — | — | — | — | — | — | — | — | — | — |
| Polyurethane 5 | — | — | — | — | 100 | — | — | — | — | — | — | — | — | — | — | — |
| Polyurethane 6 | — | — | — | — | — | 100 | — | — | — | — | — | — | — | — | — | — |
| Polyurethane 7 | — | — | — | — | — | — | 100 | — | — | — | — | — | — | — | — | — |
| Polyurethane 8 | — | — | — | — | — | — | — | 100 | — | — | — | — | — | — | — | — |
| Polyurethane 9 | — | — | — | — | — | — | — | — | 100 | — | — | — | — | — | — | — |
| Polyurethane 10 | — | — | — | — | — | — | — | — | — | 100 | — | — | — | — | — | — |
| Polyurethane 11 | — | — | — | — | — | — | — | — | — | — | 100 | — | — | — | — | — |
| Polyurethane 12 | — | — | — | — | — | — | — | — | — | — | — | 100 | — | — | — | — |
| Polyurethane 13 | — | — | — | — | — | — | — | — | — | — | — | — | 100 | — | — | — |
| Polyurethane 14 | — | — | — | — | — | — | — | — | — | — | — | — | — | 100 | — | — |
| Polyurethane 15 | — | — | — | — | — | — | — | — | — | — | — | — | — | — | 100 | — |
| Polyurethane 16 | — | — | — | — | — | — | — | — | — | — | — | — | — | — | — | 100 |
| Titanium oxide | 4 | 4 | 4 | 4 | 4 | 4 | 4 | 4 | 4 | 4 | 4 | 4 | 4 | 4 | 4 | 4 |
| Slab hardness of cover (Shore D) | 60 | 57 | 26 | 41 | 47 | 22 | 43 | 60 | 66 | 60 | 62 | 24 | 68 | 61 | 23 | 22 |
| Properties of ball | — | — | — | — | — | — | — | — | — | — | — | — | — | — | — | — |
| Abrasion-resistance | 4.5 | 5 | 4 | 4.3 | 4.6 | 4 | 4.6 | 4.8 | 4.3 | 3 | 3 | 3 | 3 | 1 | 2 | 2 |
| Durability | E | E | E | E | E | E | E | E | F | E | E | E | P | E | E | E |
| Moldability | E | E | E | E | E | F*) | E | E | E | E | E | E | E | E | E | E |
| Shot feeling | E | E | E | E | E | F | E | E | F | E | E | E | F | P | F | F |
| Resilience | 103 | 103 | 100 | 101 | 102 | 100 | 101 | 103 | 104 | 103 | 103 | 100 | 104 | 99 | 98 | 98 |

Composition: Part by mass

*)The ball had adhesiveness.

Golf balls No. 1 to No. 13 are golf balls having a cover, and the cover comprises as a base resin a polyurethane ionomer containing a polycarbonate polyol as a constitutional component. They exhibit excellent abrasion-resistance.

Golf ball No. 14 is a golf ball comprising, as a base resin, a polyurethane ionomer containing a polyether polyol component as a constitutional component, which exhibited lowering of abrasion-resistance and shot feeling. Golf balls No. 15 and No. 16 were golf balls comprising, as a base resin, polyurethane (which is not an ionomer) containing polycarbonate polyol as a constitutional component, which exhibited a tendency of lowering of abrasion-resistance, durability, and shot feeling.

The present invention is useful as a golf ball having an urethane cover which is excellent in abrasion-resistance and as a golf ball which is excellent in durability and formability.

This application is based on Japanese Patent application No. 2006-353255 filed on Dec. 27, 2006, the contents of which are hereby incorporated by reference.

What is claimed is:

1. A golf ball comprising a cover, the cover comprising, as a base resin, a polyurethane ionomer containing a polycarbonate polyol and a component containing an acidic group as a constitutional components, wherein the polycarbonate polyol has a repeating unit (A) as a repeating constitutional unit and a repeating unit (B) having a different structure from that of the repeating unit (A), and a molar ratio of (A)/(B) is 30/70 to 70/30, the repeating unit (A) represented by a following formula (I) and the repeating unit (B) represented by a following formula (II):

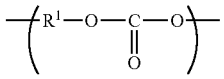

(I)

wherein $R^1$ is a bivalent residue obtained by removing two hydroxyl groups from a diol having 4 to 6 carbon atoms; and

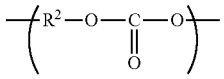

(II)

wherein $R^2$ is a bivalent residue obtained by removing two hydroxyl groups from a diol having 4 to 6 carbon atoms, and the component containing an acidic group is derived from dimethylol propionic acid, dimethylol butanoic acid, dihydroxypropionic acid, or dihydroxysuccinic acid, and a rate of content of the component containing an acidic group in the polyurethane ionomer is from 0.27 mass % to 4.5 mass %.

2. The golf ball according to claim 1, wherein $R^1$ is a bivalent residue obtained by removing two hydroxyl groups from 1,4-butanediol, 1,5-pentanediol, or 1,6-hexanediol.

3. The golf ball according to claim 1, wherein $R^1$ is a bivalent residue obtained by removing two hydroxyl groups from 1,4-butanediol, and $R^2$ is a bivalent residue obtained by removing two hydroxyl groups from 1,6-hexanediol.

4. The golf ball according to claim 1, wherein $R^1$ is a bivalent residue obtained by removing two hydroxyl groups from 1,5-pentanediol, and $R^2$ is a bivalent residue obtained by removing two hydroxyl groups from 1,6-hexanediol.

5. The golf ball according to claim 1, wherein the rate of content of the component containing an acidic group in the polyurethane ionomer is 1.4 mass % or more.

6. A golf ball comprising a cover, the cover comprising, as a base resin, a polyurethane ionomer containing a polycarbonate polyol and a component containing an acidic group as a constitutional components, wherein the polycarbonate polyol has a repeating unit (A) as a repeating constitutional unit and a repeating unit (B) having a different structure from that of the repeating unit (A), and a molar ratio of (A)/(B) is 30/70 to 70/30, the repeating unit (A) represented by a following formula (I) and the repeating unit (B) represented by a following formula (II):

(I)

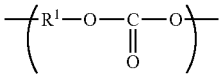

wherein $R^1$ is a bivalent residue obtained by removing two hydroxyl groups from 1,4-butanediol, 1,5-pentanediol or 1,6-hexanediol; and (II)

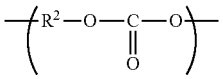

wherein $R^2$ is a bivalent residue obtained by removing two hydroxyl groups from 1,4-butanediol, 1,5-pentanediol, or 1,6-hexanediol, the component containing an acidic group is derived from dimethylol propionic acid, dimethylol butanoic acid, dihydroxypropionic acid, or dihydroxysuccinic acid, and a rate of content of a component containing an acidic group in the polyurethane ionomer is from 0.3 mass % to 3.9 mass %.

7. The golf ball according to claim 6, wherein $R^1$ is a bivalent residue obtained by removing two hydroxyl groups from 1,4-butanediol, and $R^2$ is a bivalent residue obtained by removing two hydroxyl groups from 1,6-hexanediol 8. The golf ball according to claim 6, wherein $R^1$ is a bivalent residue obtained by removing two hydroxyl groups from 1,5-pentanediol, and $R^2$ is a bivalent residue obtained by removing two hydroxyl groups from 1,6-hexanediol 9. The golf ball according to claim 6, wherein the polycarbonate polyol has a weight average molecular weight of from 1,000 to 4,000.

10. The golf ball according to claim 6, wherein the rate of content of the component containing an acidic group in the polyurethane ionomer is 1.4 mass % or more.

* * * * *